United States Patent [19]

Benedict

[11] 3,955,293

[45] May 11, 1976

[54] CONVERTIBLE FOOTWEAR AND ACCESSORIES IN ACCORD

[76] Inventor: Melvin A. Benedict, 1228 Long Run Road, McKeesport, Pa. 15131

[22] Filed: May 20, 1974

[21] Appl. No.: 471,680

[52] U.S. Cl. ..... 36/2.5 C; 36/2.5 C

[51] Int. Cl.[2] ..... A43B 00/00

[58] Field of Search ..... 36/2.5 R, 2.5 C, 2.5 W, 36/58, 58.5

[56] References Cited

UNITED STATES PATENTS

| | | | |
|---|---|---|---|
| 450,698 | 4/1891 | Saunders | 36/58 |
| 2,207,306 | 7/1940 | Taaler | 36/2.5 W |
| 2,419,390 | 4/1947 | Chertok | 36/2.5 C |
| 3,119,191 | 1/1964 | Vitzthum | 36/2.5 C |

*Primary Examiner*—Patrick D. Lawson

*Attorney, Agent, or Firm*—Hubert E. Evans

[57] ABSTRACT

Convertible footwear in accord with one's wearing apparel and accessories can be attached and interchanged to beautify and harmonize in a complimenting fashion the entire color scheme of one's appearance. The convertible footwear comprises sectioned expansible shoe veneers or shells to fit all common shoe sizes and shapes. The veneers may be made of resilient plastic for attachment and may have rib and/or welt springs for additional attachment security. The sectioned veneer may have any color scheme, texture, raised pattern or engraved surfaces. Patterned edges, such as serrated, or embroidery may enhance the veneers.

2 Claims, 6 Drawing Figures

CONVERTIBLE FOOTWEAR AND ACCESSORIES IN ACCORD

BACKGROUND

Otis T. Clark in U.S. Pat. No. 2,751,691 teaches a toe cap which is only suited for open toe shoes. This patent describes a toe cap that has a top portion with an extending flange which defines a shoulder about its inner periphery. This flange overlaps the forward edge of the vamp to properly close the joint and provide a suitable finish. These shoulder joints on the toe cap and on the out sole are covered by a flange and an insole respectively. Any gap in the juncture of the toe cap and outsole covered by the insole would bring discomfort to the wearer. These toe caps are secured by means of screws. This patent does not teach or show any gaps or breaches purposely formed in the butting face of the joints in the vamp touching part of the toe cap or in the shoulder joint of the outsole. Therefore this cap cannot provide expansion room for fitting all common sizes of shoes nor can it prevent buckling, binding or pulling apart during ambulation. In fact, U.S. Pat. No. 2,751,691 plainly states, that the recess formed by the shoulder of the outsole and covered by the insole be equal to the toe cap thickness at the bottom portion of the oval toe cap to prevent any discomfort to the wearer. This would also apply to any gap left between the outsole shoulder and the toe cap bottom. The patent specifically states that the insole extends over the juncture of the outsole shoulder and the bottom portion of the toe cap. Moreover it states that the flange on the toe cap shall overlap the forward edge of the vamp to properly close the joint.

U.S. Pat. No. 2,491,930 to Parlante describes shoes with interchangeable uppers for change to any desired style by attachment with a string of slide fastener elements such as a zipper. This type of veneer construction has only a small degree of flexibility. The lower section of the shoe veneer can fit only a few different sizes. At the extremes of these size ranges buckling and stretch distortions occur with the slightest flexing of the foot. In addition any stress applied to a zipper tends to bind the zipping or unzipping actions of the zipper. This is especially true under the flexing stress to fit different sizes and shapes of shoes because the path of the zipper makes sharper angles.

In U.S. Pat. No. 2,419,390 to Chertok an open toe shoe cap construction covers open toed shoes. This type of capping again is only possible on open toed shoes since the bottom member of the toe shoe cap construction and the toe capping element sandwich onto the vamp by penetrating the toe opening. This open toe cap type of overlay for open toed shoes is not capable of veneering any other type of shoe.

Attachment for footwear in U.S. Pat. No. 2,068,946 to Ferguson teaches a shoe provided with a single U-shaped cap made of this leather or other pliable material to conform and fit the contour of the shoe tip. This same cap has a vamp portion having rearwardly extending wings adapted to conform to the entire vamp of the shoe and extend nearly to the counter of the shoe. The cap is provided with sockets adapted to snap over studs for attachment. The location of these strategically placed studs is permanent so that there can be no size range for any one attachment.

I have found that shoe veneer sections can be held in place on the shoe by their own resilience. Also I have found that single dimensioned veneer sections can fit all common shoe sizes in either men's or women's shoes by using non-butting or non-touching gapped butt joints covered with top side laps or flanges to give a continuity to the shoe veneer. Finally the problems of the veneer sections buckling, binding or pulling apart during ambulation and stress cracking from repeated flexure are solved by my invention.

The first solution is based on veneers designed to fit with a space between the veneer sections. This space is located at their butting point between the joints to accommodate for size and shape differences and ambulation flexure. A flange is provided to give continous covering over these gaps.

SUMMARY OF INVENTION

In accordance with this invention old or new shoes can be given a rebirth of color, style, and texture for attractiveness by overlaying shoe surfaces with beautifying, expansible, self attaching (clamping), sectioned veneers. These veneers may be made of a relilient plastic to give a "clamp-on" effect.

At every juncture of the sectioned veneers, there may be a butt joint gapped and covered with a lap or flange. Therefore when the shoe veneers are fitted to any common shoe size, this gap remains to give expansion and contraction and yet maintain a continuous overlay. When the shoe is flexed it does not cause the lapped butt joints to buckle or pull apart at the veneer surface exposing the shoe.

DETAILED DESCRIPTION

This invention enables shoes to be overlayed or veneered with a quick clamp - on veneer or cap. The lapping butt joint on these veneers can adjust for size and shape differences found in all common shoe sizes. The lapping butt joints also maintain a continuous veneer surface during foot motion.

Figure 1:
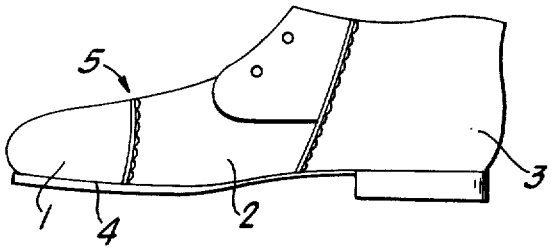
FIG. 1 is an elevational drawing of a veneered shoe with an embroidered lap.
Figure 2:
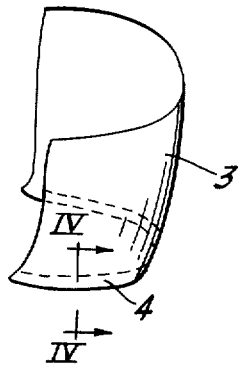
FIG. 2 is an perspective drawing of the heel veneer or cap.
Figure 3:
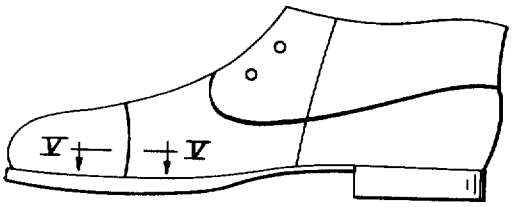
FIG. 3 is an elevational drawing of a shoe with veneer sections running in all possible planes or angles.
Figure 4:
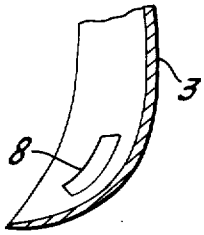
FIG. 4 is a sectional view of a cap or veneer with a spring molded in the welt extension of the veneer taken on line IV — IV of FIG. 2.
Figure 5:
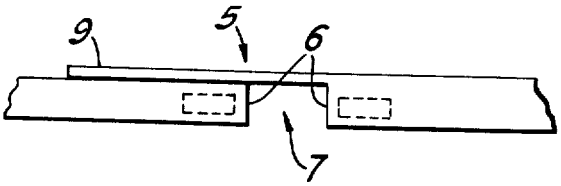
FIG. 5 is a sectional view of a separated or a breached butting joints of a veneer covered with a lap taken on line V — V of FIG. 3.

Looking at FIG. 1, a shoe is shown with a toe veneer or cap 1. The shoe may also have a vamp veneer or cap 2, and a heel veneer or cap 3. The toe and vamp veneers, or caps have their lower most edge portions or margins 4 engaged or fitting into the welt of the shoe, i.e., the junction of the sole and upper portion of the shoe.

Where there are veneers that adjoin each other there may be a flanged or lapped jointure 5 ashown in FIG. 5.

These flanged or lapped butt joints 5 provide a simple expansible shoe veneer or shell to fit all commor shoe sizes in either men's or women's shoes using a single set of sectioned overlay or veneering.

Figure 6:
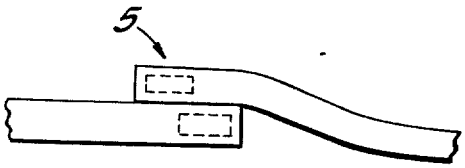
FIG. 6 is a sectional view similar to FIG. 5 of overlapping veneer sections having equal thickness of the veneer.

As shown in FIG. 5 the lapped joint may be configured so that the primary edges 6 of the two veneers may be separated by a space 7. On the other hand the joint 5 as shown in FIG. 6 may be purely an overlapped joint.

Such jointures 5 on adjoining veneers can adjust to various sizes and shapes of shoes by employing a sliding camopy effect. Expansible joints of adjoining veneers may be made to compensate for all pulling apart at the edges of the veneers by providing an overlapped joint (see FIG. 6) or by a flange 9.

Thus the adjoining veneers can be molded to fit a variety of shoe sizes without any gapping therebetween during flexure of the shoe, as occurs during running or walking.

If there is no vamp veneer, the overlapping of the toe or heel veneer may occur with respect to the shoe itself.

The expansible, sectioned veneers are secured to the shoe by either or both of two means. The shoe veneers or caps may be molded out of resilient plastic. This plastic has a resilience capable of giving the sectioned veneers a clamping power to hold each section in place on the shoe.

In addition to the holding power of the resilient plastic, U-shaped flat springs 8 can be molded into the veneers to run the course of the welt of the shoe on each veneer or over the the upper shoe. These springs may also serve as horizontal or vertical ribs. These rib or welt springs give additional holding power to resilient clamping effect of the plastic veneers to assure a snug and satisfactory fit.

The U-shaped springs may be made from a variety of shapes of spring steel such as flat, oval, square, or round springs.

The veneers, shells, or caps may be made of any suitable material. For example, they may be made of resilient plastic; but may also be made of any leather, such as, bird, reptile or animal skins; or may be made of synthetic leather, canvas, rubber, fabric, or other suitable material.

If fabric is substituted for the plastic as a material for the veneer, the springs in the welt may be required for securing purposes. Fabric may be sewed onto the spring by lapping the fabric around the spring and sewing it in place. If the veneer, shell, or cap is not fabricated of a naturally resilient material, it may be desirable to provide a resilient element, such as, a spring, by molding or attaching it into the veneer, shell, or cap in either of its longitudinal edges that may fit the shoe along the welt or in any other direction to assist in securing the shell to shoe. The sectioned veneers not only are also collapsible for handy storage.

Ideally, the springs are limited to placement in the marginal edges of the veneers. If the springs are molded or sewn in other planes of the sectioned veneers, e.g. ribs, these springs may exert localized pressure through the veneers and shoe to cause discomfort and even blisters to the wearer.

The veneers are structured so as to extend and conform to the shoe welt configuration. The welt area of the shoe forms a groove extending completely around the shoe where the sole meets all upper or non-sole parts of the shoe. The welt may be less pronounced in the heel area.

The overlapped portions of adjoining veneers or veneer and shoe can provide a fitted veneer appearance and give enhanced holding power. These overlapped portions also can prevent any of the veneers from sliding out of place even if given a serrated or a sharp stedded edge.

Other decor possible with this invention, are veneers with lace-like open work, engraved patterns, or raised or embroidered surfaces.

The resilient plastics for the shoe veneer can be any combination of thermoset, thermoplastic and elastic polymers or co-polymers which will give the desired plastic resiliency for the memory clamp-on effect and also give the greatest resistance to stress cracking under extended flexing and wear.

One suitable veneer which gives a resilient veneer may be obtained from the following recipe: Mix at a 1:1 ratio or higher premixed epoxy and rubber cement. Grease the shoe to prevent the shoe from bonding to the veneer. The mix is then spread all over a veneer which has ben trimmed to the shape of the desired veneer. The coated fabric is then superimposed on the intended shoe section for curing. The sole of the shoe can be distorted by screw clamps until complete cure of the veneer, e.g. cap or vamp, in an arc slightly smaller than the natural shoe top. Such a veneer will exert it's memory resilience to provide a clamp on attachment of the veneer to a shoe.

This invention also embraces shoe veneers stategically sectioned with the flanged or non-flanged or non-flanged butt joints on the horizontal as well as vertical to accommodate sizes out of the common range of shoe sizes.

The combined thickness of two overlapping veneers or even flanged jointures can be tapered down to the thickness of one veneer within a suitable distance in both directions from the overlap or butt. The overlap of these two types of joints thus will not be so thick as to appear bulky if the overlapping or flanges are chamfered.

What is claimed is:

1. In combination with a shoe, a removable veneer or cap for changing and enhancing the appearance of the shoe comprising:

a. a generally concave central portion to conform to and cover a portion of the shoe, b. opposed edge portions which are resilient and frictionally engage and grip welt portions of the shoe when the cap is mounted on the shoe without piercing any portion of said shoe thus providing the sole means of holding the caps onto the shoe, said opposed edge portions permitting ready removal of the cap from the shoe thus restoring the original appearance of the shoe, and c. an edge portion extending between said opposed edge portions overlaying the upper of said shoe but unconnected thereto to permit movement between said cap and the shoe during flexing of the shoe as occurs during walking.

2. In combination with a shoe, two removable veneers or caps for changing and enhancing the appearance of the shoe comprising:

a. a first cap having a generally concave central portion to conform to and cover the toe of said shoe, b. a second cap having a generally concave central portion to conform to and cover the heel of said shoe, c. each of said caps having opposed edge portions which are resilient and frictionally engage and grip welt portions of the shoe when the cap is mounted on the shoe without piercing any portion of said shoe thus providing the sole means of holding the cap onto the shoe, said opposed edge portions permitting ready removal of the caps from the shoe thus restoring the original appearance of the shoe, and d. each of said caps having an edge portion extending between said opposed edge portions overlaying and covering the toe and heel portions of the upper of said shoe but unconnected thereto to permit movement between said caps and the shoe during flexing of the shoe as occurs during walking.

* * * * *